United States Patent [19]

Marlasca Garcia

[11] 3,930,523

[45] Jan. 6, 1976

[54] CONTROL MECHANISM FOR AUTOMATICALLY OPERATED WARP BEAMS WITH AUTOMATIC SETTING

[76] Inventor: D. Francisco Marlasca Garcia, Gerona 34, Barcelona 10, Spain

[22] Filed: Nov. 26, 1973

[21] Appl. No.: 418,937

[30] Foreign Application Priority Data

Nov. 29, 1972 Spain ..... 409.085
Dec. 6, 1972 Spain ..... 409.344

[52] U.S. Cl. ..... 139/108; 139/110; 66/86 L; 242/75.51; 242/75.45

[51] Int. Cl.[2] ..... D03D 49/06

[58] Field of Search ..... 139/105–110, 139/115; 66/86 A; 318/6; 242/75.5, 75.45, 75.51

[56] References Cited

UNITED STATES PATENTS

| | | | |
|---|---|---|---|
| 1,711,385 | 4/1909 | Harris | 139/110 |
| 2,597,136 | 5/1952 | Snyder | 318/6 |
| 2,630,838 | 3/1953 | Beall | 139/110 X |
| 3,072,154 | 1/1963 | Locher | 139/110 |
| 3,125,127 | 3/1964 | Locher | 139/115 X |
| 3,364,403 | 1/1968 | Liebchen | 318/6 |
| 3,567,354 | 3/1971 | Franssen et al. | 139/108 |
| 3,753,451 | 8/1973 | Hosono et al. | 139/110 |
| 3,802,467 | 4/1974 | Steverlynck | 139/108 |

FOREIGN PATENTS OR APPLICATIONS

| | | | |
|---|---|---|---|
| 283,049 | 12/1970 | U.S.S.R. | 139/110 |

*Primary Examiner*—James Kee Chi
*Attorney, Agent, or Firm*—Toren, McGeady and Stanger

[57] ABSTRACT

In a control mechanism for automatically operating a warp beam in a loom, a comparison regulator is associated with a thread guide roller over which the warp passes and the regulator, through a cam arrangement, operates micro-switches for controlling the operation of an electric motor. The electric motor drives the warp beam through the medium of a variator. Further, an automatic zero setting is associated with the warp beam and operates in cooperation with the variator.

9 Claims, 4 Drawing Figures

CONTROL MECHANISM FOR AUTOMATICALLY OPERATED WARP BEAMS WITH AUTOMATIC SETTING

CROSS-REFERENCE TO RELATED APPLICATION

Attention is directed to Applicant's co-pending application Ser. No. 416,058, filed Nov. 15, 1973.

SUMMARY OF THE INVENTION

The present invention is directed to a control mechanism for automatically operating a warp beam and, more particularly, it is directed to the arrangement of apparatus for detecting variations in the warp passing over a thread-guide roller and transforming such variations into signals which control the operation of the warp beam. The apparatus also includes a device associated with the warp beam for providing automatic zero setting and such device is in operative communication with the apparatus which controls the operation of the warp beam.

The present invention affords substantial improvements over similar mechanisms in use up until the present time.

In fact, among the known mechanisms, the one which enjoys the widest application is based on the regulation of the speed of a variator which regulates the operation of the warp beam, through the use of a device in association with a thread guide roller which compares the tension in the warp passing over the roller with a system of weights associated with the mechanism, so that any change in thread tension forces a shift in the mechanism and such shift is kinematically transformed into a greater or lesser opening of the disks within the variator.

Initially, such a mechanism has the disadvantage that the thread-guide roller must indicate variations in tension great enough to alter the position of the variator which variations are reflected in irregularities in the fabric. Another disadvantage is that to maintain the unwinding of the warp thread, the roller must be maintained in a determined position which causes changes in the median line of the shed from the beginning to the end of the beam with the result that the conditions in the formation of the fabric are changed.

Therefore, it is the primary object of the present invention to overcome the problems experienced in similar mechanisms in the past and also to afford additional advantages.

One of the advantages provided by the present invention is the automatic zero setting which, up to the present time, was carried out either manually or by purely mechanical means. The desired regulation was provided through the shape or profile of a lever and besides a lack of precision, a manual adjustment was necessary which is totally avoided by the present invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
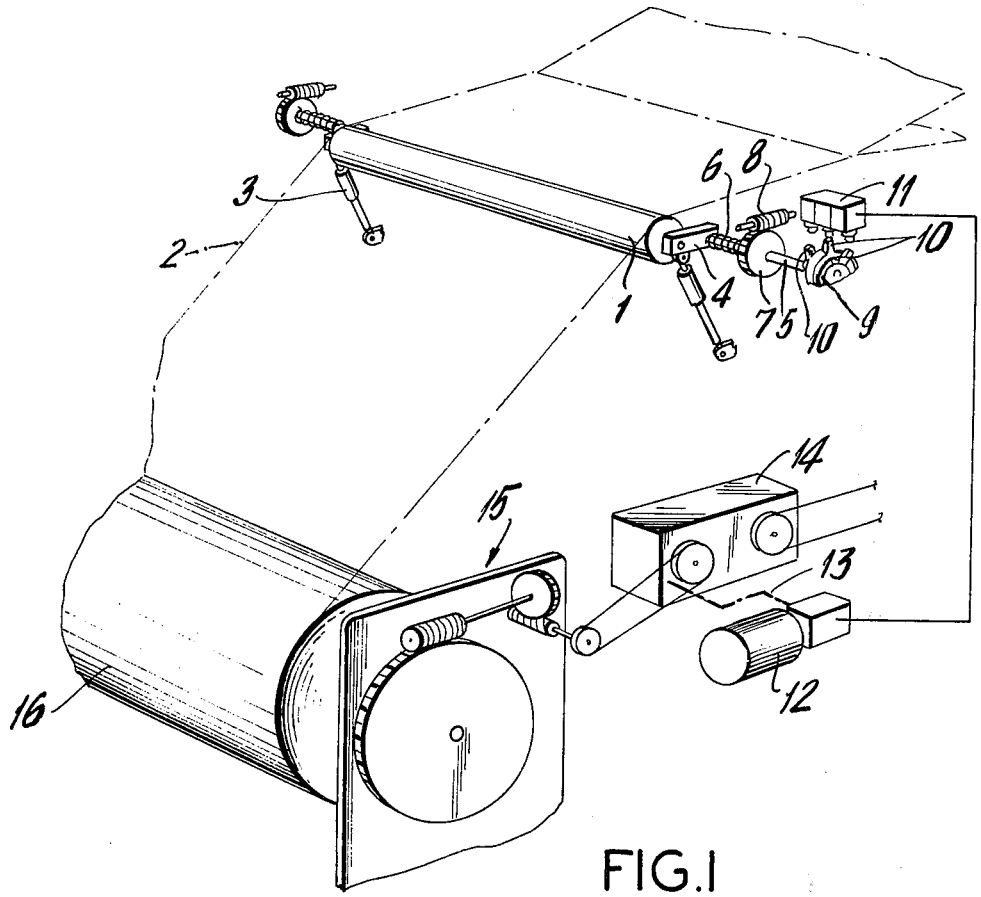
FIG. 1 is a schematic perspective view of a part of the mechanism embodying the present invention.

In FIG. 1 a portion of a loom is illustrated with the warp 2 passing over a compensating heck or thread-guide roller 1. The opposite ends of the roller 1 are supported by shock absorbers 3 and a lever 4 extends laterally from each end of the roller and a shaft 5 is connected to each lever and extends outwardly from it. A spring 6 is positioned about the shaft 5 and extends between the lever 4 and a pinion 7 located on the shaft. An endless screw or worm 8 engages the pinion 7 and moves it along the shaft for regulating the tension of the spring 6.

Positioned on the opposite end of the shaft 5 from the lever 4 is a set of cams with adjustable projections or stops 10. As can be seen in FIG. 1, there is one centrally located stop 10 and two other stops 10 spaced laterally from the central one and the stops are arranged to actuate micro-switches 11 spaced in alignment above the cams 9. These micro-switches are in operative communication with an electric motor 12 for regulating the operation of the motor. The motor 12 is connected over a transmission arrangement 13 with the control mechanism of a variator 14 (see Applicant's co-pending application, Ser. No. 416,058, filed Nov. 15, 1973 for details of the structure of the variator 14.) and the variator, through a reducing assembly 15, drives a warp beam or unwinder 16 and regulates it for releasing more or less warp in accordance with the tension sensed as the warp travels over the thread-guide roller 1. By virtue of this control arrangement a greater sensitivity is obtained and damage is avoided to the threads which may be as fine as desired. In this arrangement the thread guide roller 1 is always returned to its ideal position and the warp is maintained so that regularity in the fabric is assured. Another advantage of the present arrangement is that it is independent and autonomous with respect to the warp unwinding assembly allowing for the optimum positioning for the weaving of each fiber without changing the proper functional principles of the mechanism.

Figure 3:
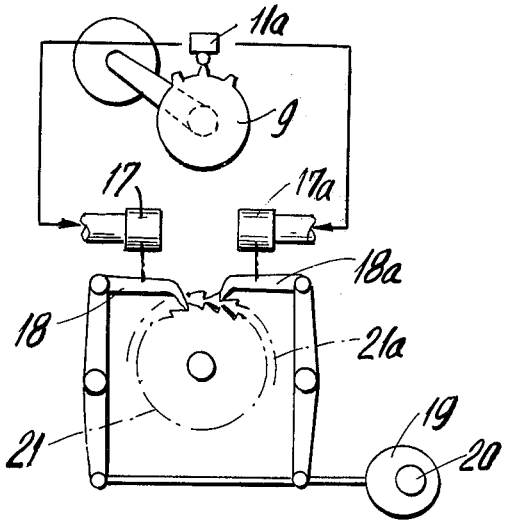
FIG. 3 is a schematic side elevational view, similar to FIG. 2, showing still another embodiment of the present invention.

In FIG. 3 another embodiment of the present invention is illustrated which uses an electromechanical arrangement with the micro-switches 11*a* each acting on a corresponding electromagnet 17, 17*a* which, in turn, control the position of pawls 18, 18*a* each of which is connected to a parallelogram structure articulated, for alternating movement, to a cam 19 mounted on a synchronization shaft 20 of the loom to afford movement in the rightward or leftward direction, according to the impulse provided by the electromagnets, to corresponding ratchet wheels 21, 21*a* positioned on the transmission arrangement 13 for regulating the warp beam.

In still another embodiment, a mechanical connection is provided between the heck or thread-guide roller 1*a* and the warp beam. In this arrangement, a three-armed lever is connected to the heck 1*a* by means of one of its arms while the other two arms are connected by cables or pull rods 22, 22*a* to the pawls 18*b*, 18*c* incorporated into the parallelogram structure and arranged to engage the ratchet wheels 21*b*, 21*c*.

Figure 2:
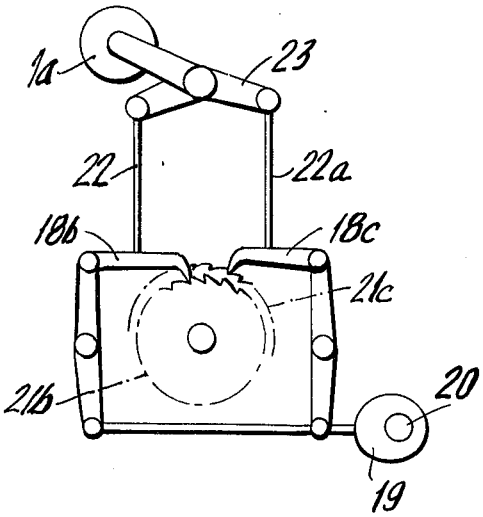
FIG. 2 is a schematic side elevational view of another embodiment of the invention.

Either of the embodiments shown in FIGS. 2 and 3 may also be used in lieu of the means for checking variations in the warp tension shown in FIG. 1, represented by the spring 6, pinion 7, endless screw 8, cams 9, stops 10, and micro-switches 11, and in lieu of the means for controlling the operation of the warp beam shown in FIG. 1, represented by the motor 12.

Figure 4:
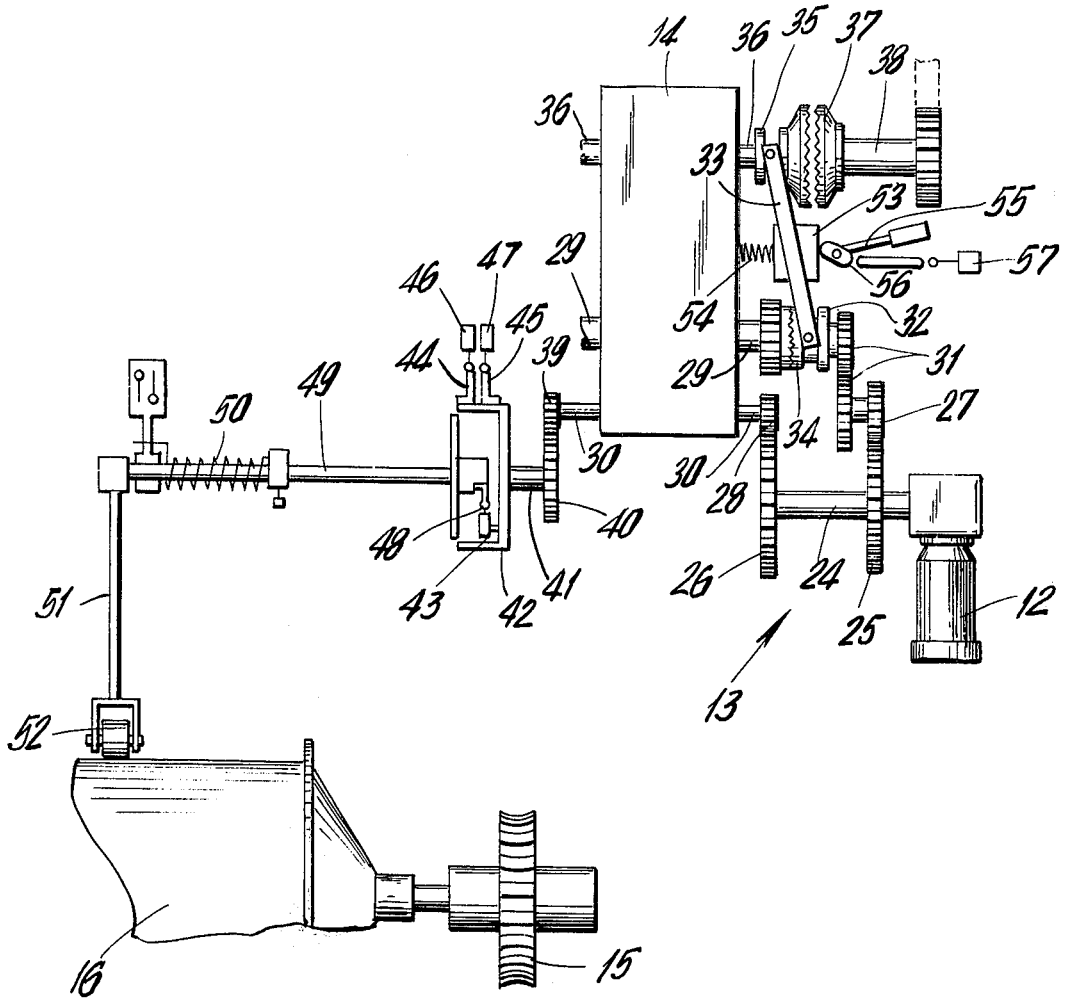
FIG. 4 is a schematic view of the automatic zero setting device of the present invention.

In FIG. 4 the automatic zero setting device of the present invention is illustrated and includes the electric motor 12 which operates the variator 14 over its transmission 13. The transmission 13 includes a driven shaft 24 extending from the motor 12 and having two gear wheels 25, 26 mounted on the shaft and in meshed engagement with pinions 27, 28, respectively. The pinion 27 is connected over a reduction gear assembly 31, an anchor or brace member 32 and a clutch member 34 to the rotating shaft 29. The pinion 28 is mounted on one end of the control shaft 30. A fork member 33 is connected at one end to the anchor 32 and extends transversely from the axis of the rotating shaft 29 and is secured at its other end to another anchor 35 on the driving shaft 36 of the variator 14. Another clutch member 37 is connected to the driving shaft 36 for selectively connecting it to another shaft 38 which, in turn, is connected to the rest of the synchronizing devices of the loom.

At its end opposite the pinion 28, the control shaft 30 terminates in another pinion 39 which meshes with a gear wheel 40 mounted on a shaft 41 to which a plate bushing 42 is connected. A micro-switch 43 is mounted within the plate bushing and rotates with it and stops 44, 45 are positioned on the exterior of the plate bushing and act as safety mechanisms for the limits of the variator and in such operation cooperate with disconnectors 46, 47 to provide control similar to that afforded by the switch 43 on the motor 12.

The micro-switch 43 cooperates with an end stop 48 on a shaft 49 and a biasing spring 50 is positioned adjacent the opposite end of the shaft from the end stop 48. At the opposite end of the shaft 49 from the end stop 48 a diameter sensing arm 51 extends transversely outwardly and has a wheel 52 on its outer end which contacts the exterior of the warp beam 16. Based on this arrangement, the present invention operates in the following manner: As indicated in FIG. 4, the fork 33 is mounted on a block 53 and a biasing spring urges the block against a cam 56 mounted on a lever 55. When the fork 33 is moved from the position shown in FIG. 4, the clutch member 37 is connected and the other clutch member 34 is disconnected so that the movement provided by the loom passes through the variator to the warp beam by means of the pinion 15. Accordingly, the sensing arm 51 becomes inoperative and only the microswitches 46, 47 are operative to limit the stroke of the variator 14. However, when the lever 55 is moved in the opposite direction, to the position shown in FIG. 4, the motor 12 is connected to the rotating shaft 29 of the variator. It should be noted, however, that a safety micro-switch 57 prevents the starting of the loom, since it acts in cooperation with the position of the lever 55. Thus, when the empty warp beam is replaced by a full one, the sensing arm 51 and its associated stop 48 on the shaft 49, varies angularly to the new diameter of the warp beam. When the motor is started, the control shaft 30 and the rotating shaft 29 of the variator commence rotation and, as a result, the plate bushing 42 also rotates until the microswitch 43 contacts the stop 48 and when this contact takes place, the motor stops because the zero setting of the variator has been accomplished. By again acting on the lever 55 the loom can be set in motion to commence its operational cycle.

Therefore, since the control of the mechanism is fully automatic, the fabric has, from the outset, the desired quality, and no specialized labor is required in weaving the fabric.

Although FIG. 4 shows the automatic zero setting device of the present invention in combination with the means for checking variations in the warp tension and the means for controlling the operation of the warp beam illustrated in the embodiment of FIG. 1, it is of course possible to use the embodiments of FIG. 2 or FIG. 3 in place of the embodiment of FIG. 1.

Regardless of which embodiment is used in combination with the automatic zero setting shown in FIG. 4, the automatic zero setting device of the present invention will operate in the same manner. That is, it will set up the control mechanism in its initial position in order to reflect the maximum diameter of the warp beam. This is required so that the variator 14 will operate correctly. The zero setting is carried out when an empty warp beam is removed and a new one provided which has the initial maximum diameter.

The zero setting is a reference base for the variator to control the rotation of the warp beam in response to variations in tension sensed by the embodiments shown in either FIG. 1, 2, or 3. If the variator were not initially referenced, the roller 52 and lever 51 would be in a setting which corresponds to the minimum diameter of a warp beam, since the warp beam removed would have been empty. The zero setting sets up a base that is indicative of the maximum diameter of the warp beam which can vary according to load. The novelty of the present invention as regards to this zero setting is that the setting can be obtained automatically as opposed to the manual operations of the prior art.

The invention, in its essence, can be carried into effect in other forms which differ only in detail from that described above which has been provided only by way of example. The control mechanism for warp beams with automatic setting, can be realized with the most suitable means, components and accessories.

I claim:

1. Control mechanism for automatically regulating warp beams with automatic zero setting, comprising means for checking variations in warp tension, a warp beam, means for controllably operating said warp beam, said means for controllably operating said warp beam comprising driving means for controlling said warp beam and means connected to said means for checking variations in warp tension for controlling said driving means, an automatic zero setting device comprising a transmission connected to said driving means, a variator operatively connected to said transmission, and sensing means contacting said warp beam for sensing the diameter thereof, and a reducing assembly connected to said variator for driving said warp beam.

2. Control mechanism, as set forth in claim 1, wherein said means for checking variations in warp tension comprises a member in contact with said warp and over which the warp passes, a spring-biased comparison regulator connected to said member and arranged to transmit variable movement in respect to the tension in the warp passing over said member, said driving means comprises an electric motor, and said means for controlling said driving means comprises switch means connected to said electric motor and actuated by said comparison regulator for affording variable operation of electric motor.

3. Control mechanism, as set forth in claim 2, wherein said comparison regulator comprises a lever connected to said member, a shaft connected at one end to said lever, and a plurality of stops mounted at the other end of said shaft, said stops rotating in response to said shaft rotation and controlling said switch means.

4. Control mechanism, as set forth in claim 1, wherein said means for checking variations in warp tension comprises a member in contact with said warp and over which the warp passes, a three-armed lever, one arm of said three-armed lever connected to said member and pivotable in response thereto, and said means for controlling said driving means comprises a pulling member associated with each of the other two arms of said three-armed lever.

5. Control mechanism, as set forth in claim 4, wherein said driving means of said means for controllably operating said warp beam comprises ratchet wheels mounted on said transmission means, a synchronization shaft for the loom, a cam mounted on said synchronization shaft, a parallelogram structure connected to said cam for transmitting alternating movement, pawls connected to said parallelogram structure and arranged to engage said ratchet wheels for regulating movement of said warp beam, and said pulling members connected to said pawls for selectively positioning said pawls in relation to the variations in warp tension.

6. Control mechanism, as set forth in claim 1, wherein said means for checking variations in warp tension comprises a member in contact with said warp and which warp passes over said member, a spring-biased comparison regulator connected to said member and arranged to transmit variable movement in respect to the tension in the warp passing over said member, said driving means comprises ratchet wheels mounted on said transmission means, a synchronization shaft for the loom, a cam mounted on said synchronization shaft, a parallelogram structure connected to said cam for transmitting alternating movement, pawls connected to said parallelogram structure and arranged to engage said ratchet wheels for regulating movement of said warp beam, and an electromagnet associated with each of said pawls and connected to said means for controlling said driving means.

7. Control mechanism, as set forth in claim 2, wherein said means for checking variation in said warp tension includes a thread-guide roller constituting said member arranged to support the warp, and said comparison regulator comprises shock absorbers supporting the ends of said thread-guide roller, a lever secured to each end of said thread-guide roller and extending laterally therefrom, a shaft connected to said lever at a position spaced laterally from the connection of said lever to said thread-guide roller, a pinion mounted on said shaft and displaceable axially thereon, a spring mounted on said shaft and in contact with said pinion, means for driving said pinion on said shaft for regulating the biasing action of said spring, a cam member mounted on said shaft for rotation therewith, a plurality of adjustable stops on said cam member, and said switch means comprises a plurality of micro-switches arranged to be operated by said adjustable stops on said cam member and to operate said electric motor.

8. Control mechanism, as set forth in claim 7, wherein said sensing means arranged to sense the diameter of said warp beam comprises a first shaft, a diameter-sensing arm attached to and extending radially outwardly from one end of said first shaft, a wheel mounted on the end of said sensing arm spaced outwardly from said first shaft for contacting the exterior of said warp beam, an end stop secured to the opposite end of said first shaft from the end to which said sensing arm is attached, a pinion mounted on said control shaft of said variator spaced from the connection of said drive means to said control shaft, a gear wheel in meshed engagement with said pinion of said control shaft, a second shaft mounting said gear wheel, a plate bushing mounted on said second shaft at a position spaced from said gear wheel and said plate bushing extending outwardly from said second shaft over the end of said first shaft on which said end stop is located, a micro-switch mounted within said plate bushings, stops mounted on the exterior of said plate bushing, disconnectors mounted opposite said stops in the path of movement thereof, and said micro-switch in said plate bushing arranged to be contacted by said stops on the end of said first shaft for stopping the operation of said electric motor.

9. Control mechanism for automatically regulated warp beams with automatic zero setting, comprising a warp beam, a zero setting device comprising an assembly arranged to sense the diameter of said warp beam, a variator arranged to control the operation of said warp beam, said variator including a control shaft, a rotating shaft, and a driving shaft, said driving shaft arranged and connected to the synchronization devices in the loom associated with said warp beam, an electric motor, drive means extending between said electric motor and said control shaft and rotating shaft, a master safety switch for the loom associated with said warp beam, a first coupling in said drive means selectively connecting said rotating shaft to said electric motor, a second coupling for selectively coupling said driving shaft to the synchronizing devices in the loom, a fork interconnecting said first coupling and second coupling, a control lever arranged to displace said fork for selectively connecting said first and second couplings and also arranged to act on said master safety switch.

* * * * *